United States Patent [19]

Millianowicz

[11] Patent Number: 4,650,939

[45] Date of Patent: Mar. 17, 1987

[54] VACUUM CIRCUIT INTERRUPTER HAVING HEAT EXCHANGER FOR TEMPERATURE CONTROL

[75] Inventor: Stanislaw A. Millianowicz, Monroeville Boro, Pa.

[73] Assignee: Westinghouse Electric Corp., Pittsburgh, Pa.

[21] Appl. No.: 822,180

[22] Filed: Jan. 24, 1986

[51] Int. Cl.[4] ..... H01H 33/66

[52] U.S. Cl. ..... 200/144 B; 200/289; 200/50 AA

[58] Field of Search ..... 200/144 B, 289, 50 AA

[56] References Cited

U.S. PATENT DOCUMENTS

| | | | |
|---|---|---|---|
| 1,152,616 | 9/1915 | Edison | 200/289 |
| 1,886,758 | 11/1932 | Swars | 200/289 |
| 3,466,412 | 9/1969 | Mikeska | 200/289 |
| 3,958,093 | 5/1976 | Cleaveland | 200/144 B |
| 3,973,096 | 8/1976 | Burgoon | 200/144 B |
| 4,005,297 | 1/1977 | Cleaveland | 200/144 B |
| 4,376,235 | 3/1983 | Milianowicz | 200/50 AA |
| 4,384,179 | 5/1983 | Milianowicz | 200/50 AA |

*Primary Examiner*—Robert S. Macon
*Attorney, Agent, or Firm*—D. S. Buleza

[57] ABSTRACT

Overheating of the contacts and associated current-carrying parts of a vacuum type circuit breaker is prevented by fastening a U-shaped heat exchanger component of non-magnetic sheet metal to a protruding portion of the stem that is located at the top of the breaker bottle and is integral with the stationary contact. The U-shaped heat exchanger component is secured in inverted position on the stationary stem and the downwardly-extending skirts of the heat exchanger are slotted to provide a series of spaced ribs which form planar grid structures that allow ambient air to flow through the heat exchanger component and enhance its heat transfer characteristics. The heat exchanger component is secured to the stationary stem by conical-shaped washers that curve toward and are compressed flat against the flat central portion of the heat exchanger component in sandwiched relationship therewith by a lock nut which engages threads on the stem and thus firmly clamps the various components together on top of the circuit breaker and the leaf conductor assembly that is fastened to the stem.

10 Claims, 7 Drawing Figures

VACUUM CIRCUIT INTERRUPTER HAVING HEAT EXCHANGER FOR TEMPERATURE CONTROL

BACKGROUND OF THE INVENTION

1. Field of the Invention

This invention generally relates to circuit interrupter apparatus and, more particularly, to an improved vacuum type circuit breaker having an attached heat exchanger assembly which cools and thus prevents the contacts and associated current-carrying parts of the breaker from overheating during closed-circuit operation.

2. Description of the Prior Art

It is customary in the vacuum circuit breaker art to provide some means of cooling the current-carrying parts of the circuit breaker to prevent excessive temperature rises which may be produced by the passage of current through the breaker and result in overheating which could damage the breaker and/or interfere with its normal operation. In conventional vacuum type circuit breakers having current-carrying conductors of the solid bar type such cooling means comprises one or more extruded metal components of finned construction that are fastened to the solid-bar conductors and function as heat exchangers. However, it is impractical to employ such cooling components in vacuum circuit breakers having current-carrying conductors that consist of a plurality of bundled leaf-like conductor elements that provide "stiff flexible" type conductor assemblies since there is no convenient location along the flexible conductor assemblies where a finned cooling component can be attached. A circuit breaker having such a "stiff flexible" leaf conductor assembly that is connected to the movable contact stem of a vacuum type circuit breaker is disclosed and claimed in U.S. Pat. No. 4,384,179 issued May 17, 1983 to S. A. Milianowicz, the author of the present invention. The use of such a leaf conductor assembly on the stationary end of the circuit breaker as well as the movable end provides an improved circuit breaker structure and it is this type of circuit breaker which presented the problem that is addressed by the present invention.

The provision of an inexpensive heat exchanging assembly that can be easily manufactured and then mounted directly on such an improved vacuum circuit breaker having the aforementioned "stiff flexible" bundled leaf-like conductor assemblies to efficiently cool the current-carrying parts of the breaker would accordingly be advantageous from both a functional and cost standpoint.

SUMMARY OF THE INVENTION

The present invention provides the foregoing manufacturing and operational advantages by utilizing a heat exchanger component that is mounted on the stationary end of the circuit breaker and is cut and stamped from a suitable non-magnetic sheet metal (such as copper or aluminum) in such a fashion that it has a U-shaped configuration. The depending portions or skirts of the heat exchange are slotted to provide a series of spaced ribs that form a grid structure which permits ambient air to flow through the heat exchanger. The flat central portion of the U-shaped heat exchanger is provided with an aperture which permits the heat exchanger to be slipped over the threaded end of the metal stem that protrudes from the top of the vacuum circuit breaker bottle and is integral with the stationary contact located inside the bottle.

The U-shaped heat exchanger component is mounted in inverted position on the stationary contact stem and is firmly clamped in pressured engagement with the stem and attached leaf conductor assembly by conical-shaped washers that are disposed in sandwiched relationship on either side of the flat central portion of the heat exchanger and are compressed flat by a locking nut on the threaded end of the stem. The mechanical interaction between the leaf conductor assembly, the washers, overlapped portions of the central segment of the heat exchanger and breaker stem provides a heat conducting cross-section of metal several layers thick at the central portion of the heat exchanger which ensures that heat from the breaker stem and associated current-carrying leaf conductor assembly of the circuit breaker will be efficiently transferred to the heat exchanger and then be dissipated by the convection cooling effected by ambient air that circulates through the circuit breaker enclosure and the ribbed skirt portions of the heat exchanger.

Efficient cooling and reliable control of the operating temperature of the contacts and associated current-carrying "stiff flexible" leaf conductor assemblies of the vacuum circuit breaker are accordingly achieved by a heat exchanger structure that can be readily manufactured at minimum cost and then be easily mounted and bolted in place on top of the circuit breaker in a very efficient manner.

BRIEF DESCRIPTION OF THE DRAWINGS

A better understanding of the invention will be obtained from the exemplary embodiments shown in the accompanying drawings, wherein.

DESCRIPTION OF THE PREFERRED EMBODIMENTS

While the improved heat exchanger cooling assembly of the present invention can be employed on various kinds of circuit interrupter and switchgear apparatus which have contacts and current-carrying components that are susceptible to overheating during operation, it is particularly adapted for use in conjunction with medium voltage circuit breakers of the vacuum type and it has accordingly been so illustrated and will be so described.

Figure 1:
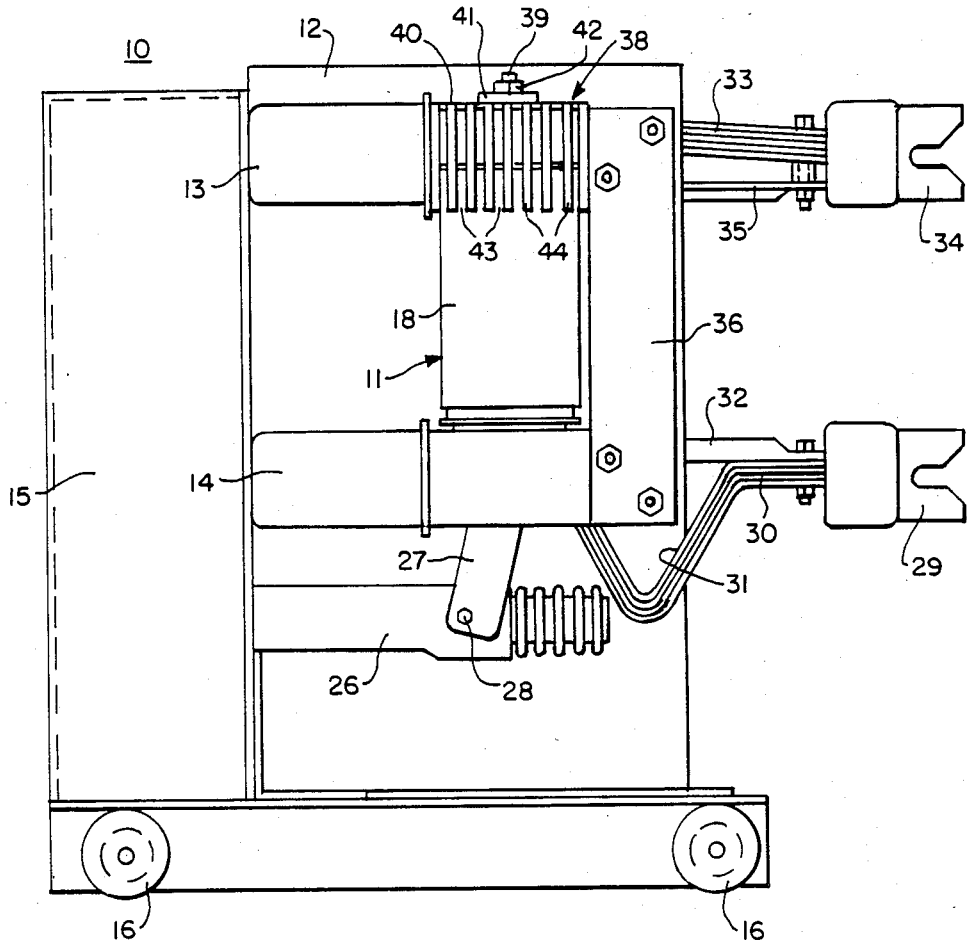
FIG. 1 is a side-elevational view of a drawout circuit interrupter module having a vacuum type circuit breaker unit that is provided with the improved heat exchanger cooling assembly of the present invention.

In FIG. 1 there is shown a draw-out circuit interrupter module 10 which comprises a tubular vacuum type circuit breaker 11 that is held in upstanding position by a metal chassis 12 that includes a pair of horizontally extending support structures 13, 14 that are fabricated from suitable non-conductive material and are secured to the wall of a compartment 15 that houses the operating mechanism and other components which control the operation of the circuit breaker. The supporting chassis 12 is provided with wheels 16 which ride on rails (not shown) and permit the circuit breaker module 10 to be withdrawn and then reinserted into a protective metal enclosure (not shown) in the customary manner. Since medium voltage circuit breakers are typically of the three-pole type, the module 10 contains three vacuum circuit breaker components although only one is visible in the view illustrated.

Figure 2:
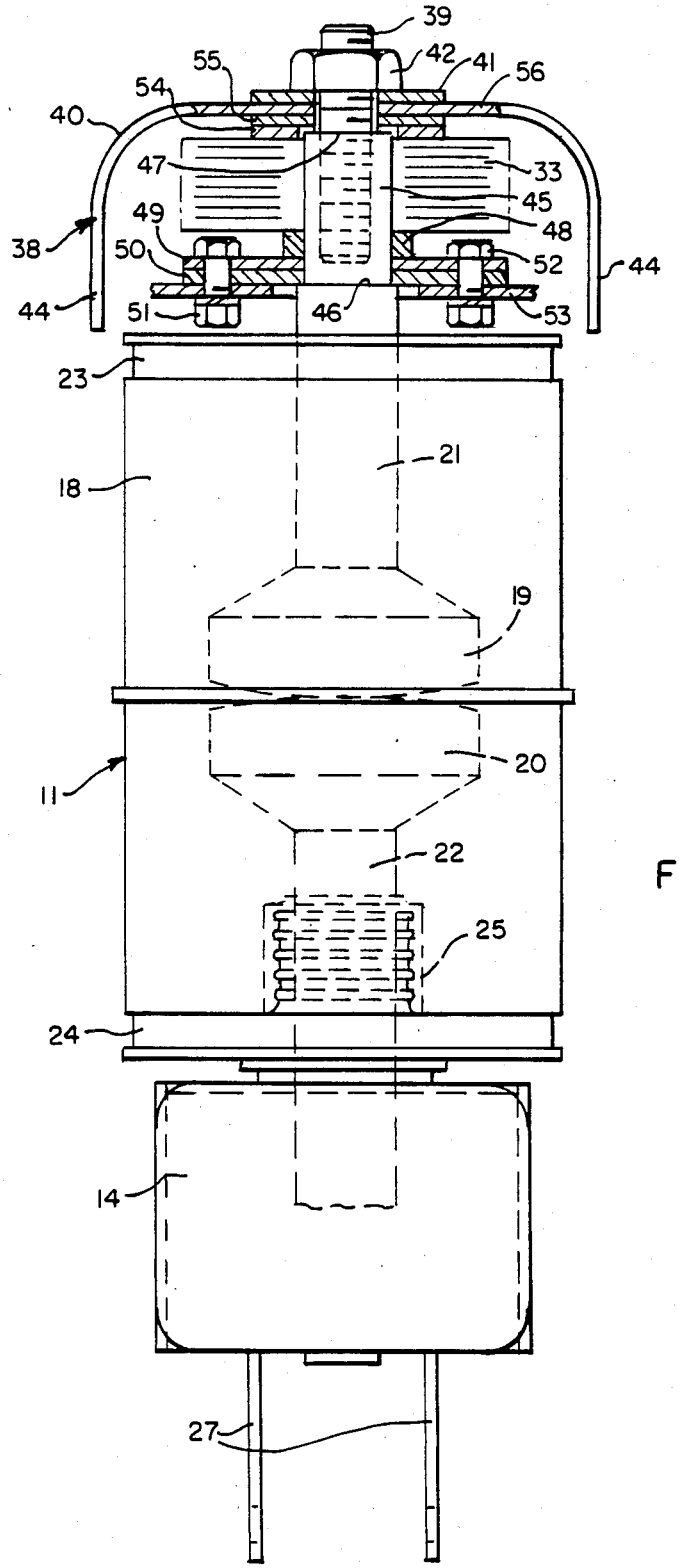
FIG. 2 is a an enlarged elevational view of the vacuum circuit breaker unit, the heat exchanger cooling assembly and associated "stiff flexible" leaf conductor assembly, parts of which are shown in cross-section.

As shown more particularly in FIG. 2, the vacuum circuit breaker 11 comprises a cylindrical housing or bottle 18 of rigid insulating material that contains a pair of separable contacts 19, 20 that are supported within the bottle 18 by a pair of metal stems 21, 22 which extend through and beyond metallic closure members 23, 24 that are attached to and seal the ends of the insulative bottle 18. In accordance with standard practice, the bottle 18 is evacuated and one of the contact and stem assemblies is movable toward and away from the other contact and stem assembly to permit the contacts 19, 20 to be opened and break the circuit. In the illustrated embodiment, the lowermost contact 20 and its stem 22 are movable and the associated end closure member 24 includes a flexible bellows structure 25 which permits such movement without rupturing the sealed bottle 18.

Returning now to FIG. 1, the movable contact 20 is actuated by a drive rod 26 of insulating material that is coupled to a bell crank 27 by a pin 28 so that reciprocal movement of the rod 26 by the operating mechanism within the front compartment 15 causes the coupled bell crank 27 ot move the stem 22 in such a fashion that the contact 20 is rapidly moved into and out of engagement with the other contact 19 in the usual manner. The movable contact 20 is conected to a primary contactor 29 by a "stiff flexible" type leaf conductor assembly 30 that consists of a series of thin conductor plates that are secured in stacked relationship with one another to permit the resulting conductor assembly 30 to be rigid but still flexible enough to accommodate the reciprocal movement of the movable contact 20 and stem 22 to which it is attached. The conductor assembly 30 is provided with a V-bend 31 to further facilitate such flexibility. A support arm 32 which extends from the insulative support 14 is fastened to the leaf-conductor assembly 30 to hold it in place. The structural details and various advantages which such a bundled leaf-conductor assembly provides are illustrated and described in the aforementioned U.S. Pat. No. 4,384,179 and the subject matter disclosed in the aforesaid patent is incorporated by reference into this application.

A similar bundle of plate conductors (without a V-bend) provides a second leaf conductor assembly 33 that electrically connects the stationary stem 21 and contact 19 of the circuit breaker 11 to a second primary contactor 34. Another support arm 35 is fastened to insulator support 13 and the leaf conductor assembly 33 as a reinforcing means. A pair of insulative tie bars 36 secured to the horizontal insulative support members 13, 14 and support arms 32, 33 also hold the leaf conductor assemblies 30, 33 in place and provide the rigidity required to permit the primary contactors 29, 34 to engage and interlock with a pair of mating power terminals located at the back of the enclosure (not shown) when the circuit interrupter module 10 is inserted into the enclosure.

In accordance with the present invention, the vacuum circuit breaker 11 is provided with an integral cooling assembly 38 that is mounted on top of the breaker bottle 18 which, in turn, is provided with a protruding threaded stud 39 that is anchored in the stationary stem 21. The cooling assembly 38 comprises a heat exchanger 40 of generally U-shaped cross-section and three coupling washers (only the outermost washer 41 being shown in Figure 1) that are fastened to the stud 39 and leaf conductor assembly 33 by a lock nut 42—the heat exchanger 40 being disposed in the illustrated inverted position. The downwardly extending end portions or skirts of the heat exchanger 40 are provided with a series of notches such as slot openings 43 which provide a plurality of evenly spaced elongated elements such as ribs 44 that form a pair of planar grid structures that are disposed on opposite sides of the upper portion of the breaker bottle 18 and permit ambient air to flow upwardly through the heat exchanger 40. This increases convection cooling of the heat exchanger 40 and improves its heat transfer characteristics. The heat exchanger 40 and coupling washers are fabricated from sheet metal such as copper or aluminum which not only is a good heat conductor but non-magnetic. The structural details of the cooling assembly 38 and the manner in which it is attached to the stationary contact stem 21 and leaf conductor assembly 33 are illustrated in FIGS. 2–5 and will now be described.

As shown in FIG. 2, the mounting of the heat exchanger assembly 38 on the top of the vacuum circuit breaker 11 is achieved by fabricating the stationary stem 21 in such a manner that the exposed portion of the stem that protrudes beyond the closure member 23 is terminated by a medial segment 45 that is of smaller cross-sectional dimension than the main portion of the stem 21. The medial segment 45, in turn, is terminated by the threaded stud 39 which is of smaller cross-sectional dimension than the medial segment 45 and is threadably anchored therein. The stem 21 is preferably circular in cross-section so that the aforementioned progressive reduction in cross-sectional dimensions is achieved by making the diameter of the medial segment 45 smaller than the diameter of the body of the stem 21 and by making the threaded stud 39 smaller in diameter than the diameter of the medial segment 45. The differences in diameter provide an annular ledge or flange 46 at the juncture of the medial segment 45 with the main body of the stem 21 and another annular ledge or flange 47 at the juncture of the medial segment 45 and the stud 39.

As will be noted, the stacked plate conductors which form the leaf conductor assembly 33 are provided with tight-fitting apertures which permit the stacked conductors to be slipped over the unthreaded medial segment 45 of the stem 21 on top of an annular bushing 48 which serves as a spacer means between the conductor assembly 33 and a pair of support plates 49, 50 that are seated on the stem flange 46. The support plates 49, 50 are fastened by a pair of bolts 51, 52 to a support bracket 53 which, in turn, is secured to the insulative main support member 13. In accordance with the teachings of U.S. Pat. No. 4,376,235 entitled "Electrical Junction Of High Conductivity For A Circuit Breaker Or Other Electrical Apparatus" issued Mar. 8, 1983 to the author of the present invention (which teachings are incorporated by reference into the present application for the details of the connection of the conductor plates to the stationary stem 21), the apertured portions of the conductor plates are slit to provide offset tabs (not shown) which are forced into mechanically bonded relation with the medial segment 45 of the stem 21 when the stacked plates are compressed in a direction along the steam axis. The leaf conductor assembly 33 is thus securely locked in positive electrical engagement with the stem 21 on top of the bushing 48, support plates 49, 50 and the support bracket 53. The other leaf conductor assembly 30 is fastened to the other stem 22 in the same manner.

As shown in FIG. 2 (and more clearly in FIGS. 4 and 5), the number of conductor plates in the compressed leaf conductor assembly 33 is such that the top plate is located slightly below the stem flange 47.

The U-shaped heat exchanger 40 is attached to the stationary stem 21 and leaf conductor assembly 33 by slipping a pair of metal washers 54, 55 over the threaded stud 39 on top of the leaf conductor assembly 33 and then slipping the apertured flat central portion 56 of the inverted heat exchanger 40 over the stud 39 and orienting the heat exchanger 40 so that the central portion 56 extends laterally beyond the stem 21 and the downwardly extending ribs 44 are disposed in parallel-spaced planes on either side of the stem 21 and breaker bottle 18. The third washer 41 is then slipped over the threaded stud 39 and the lock nut 42 is placed on the stud and tightened so that the washers 41, 55 are firmly clamped in pressured contiguous relationship with the flat central portion 56 of the heat exchanger 40 and the innermost washer 54 is tightly clamped between washer 55 and the underlying leaf conductor assembly 33. The circular aperture in washer 54 is larger than the diameter of the unthreaded medial segment 45 of the stem 21 so that washer 54 clears the stem flange 47 and rests on the leaf conductor assembly 33 in encircling relationship with stem segment 45. In contrast, the circular apertures in the other two washers 41, 55 and in the central portion 56 of the heat exchanger 40 are smaller than the diameter of the medial segment 45 of the stem 21 so that these components are disposed in slip-fitted centered position on the stud 39. Washer 54 is of sufficient thickness that it protrudes beyond the plane of the stem flange 47, as shown in FIG. 2.

The physical shape and arrangement of the various components of the cooling assembly 38 are accordingly such that tightening of the lock nut 42 compresses the disc washers 41, 55 in sandwiched relationship with the central portion 56 of the heat exchanger 40 between the nut 42 and innermost disc washer 54. The slight gap between the stem flange 47 and washer 55 (provided by washer 54) ensures that the cooling assembly 38 is in tightly clamped relationship with the leaf conductor assembly 33 and not the stem flange 47.

The tight clamping of the cooling assembly 38 to the leaf conductor assembly 33 and stationary stem 21 by the locking nut 42 and coupling washers 41, 54, 55 provides a good heat conductive path between the closed contacts 19, 20, the stem 21, leaf conductor assembly 33 and the heat exchanger 40. The washers 41, 54 and 55 provide several layers of metal at the juncture of the heat exchanger 40 with the stud 39 and leaf conductor assembly 33 and provides a very efficient heat conductive cross-section at the central portion 56 of the heat exchanger.

Figure 3:
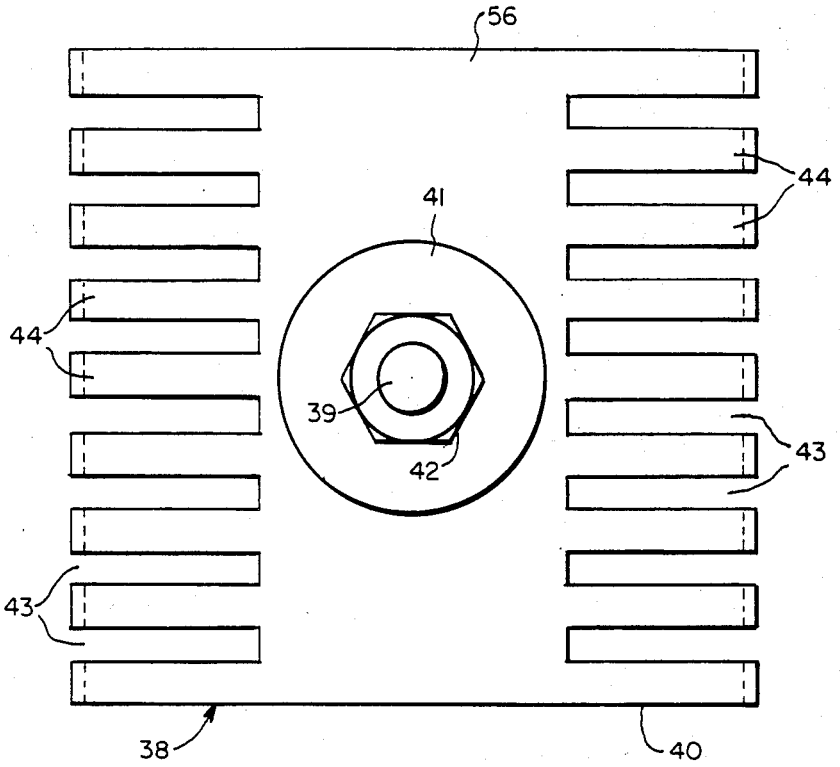
FIGS. 3 and 4 are enlarged plan and elevational views, respectively, of the heat exchanger assembly and the connecting parts of the stationary stem of the circuit breaker and associated leaf conductor assembly.

As will be noted in FIG. 3, the coupling washer 41 is of circular configuration and the slots 43 in the skirt portions of the heat exchanger 40 extend around into the flat central portion 56 of the heat exchanger to facilitate the circulation of air through the cooling assembly 38. The coupling washers 54, 55 disposed beneath the heat exchanger 40 are preferably of the same shape and size as washer 41, except that the circular hole in washer 54 is larger as previously stated.

Figure 4:
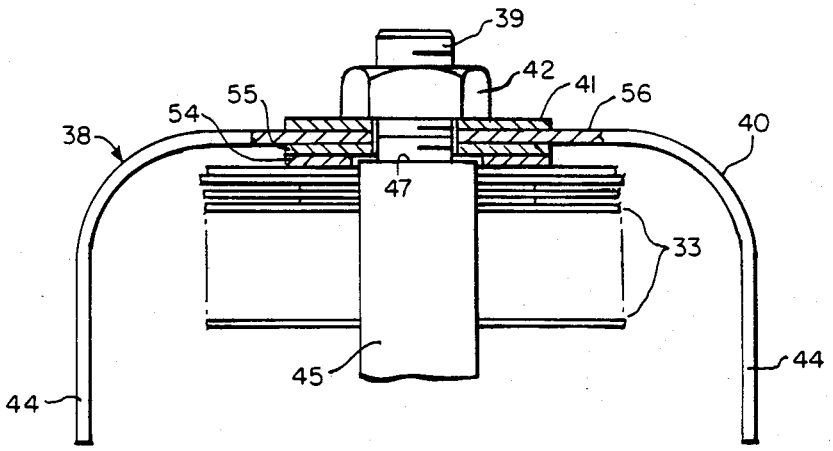

As illustrated in FIG. 4, the size of the circular apertures in the disc washers 41, 55 and the central portion 56 of the heat exchanger 40 are such that a snug sliding fit is effected between these components and the threaded stud 39 of the stationary stem 21. The larger aperture in the disc washer 54, on the other hand, ensures that this washer clears the stem flange 47 and engages the leaf conductor assembly 33. As will also be noted, the ribs 44 are disposed in transversely-extending planar array relative to the central portion 56 of the heat exchanger 40 and the grids formed by the ribs 44 are in parallel spaced relationship.

Figure 5:
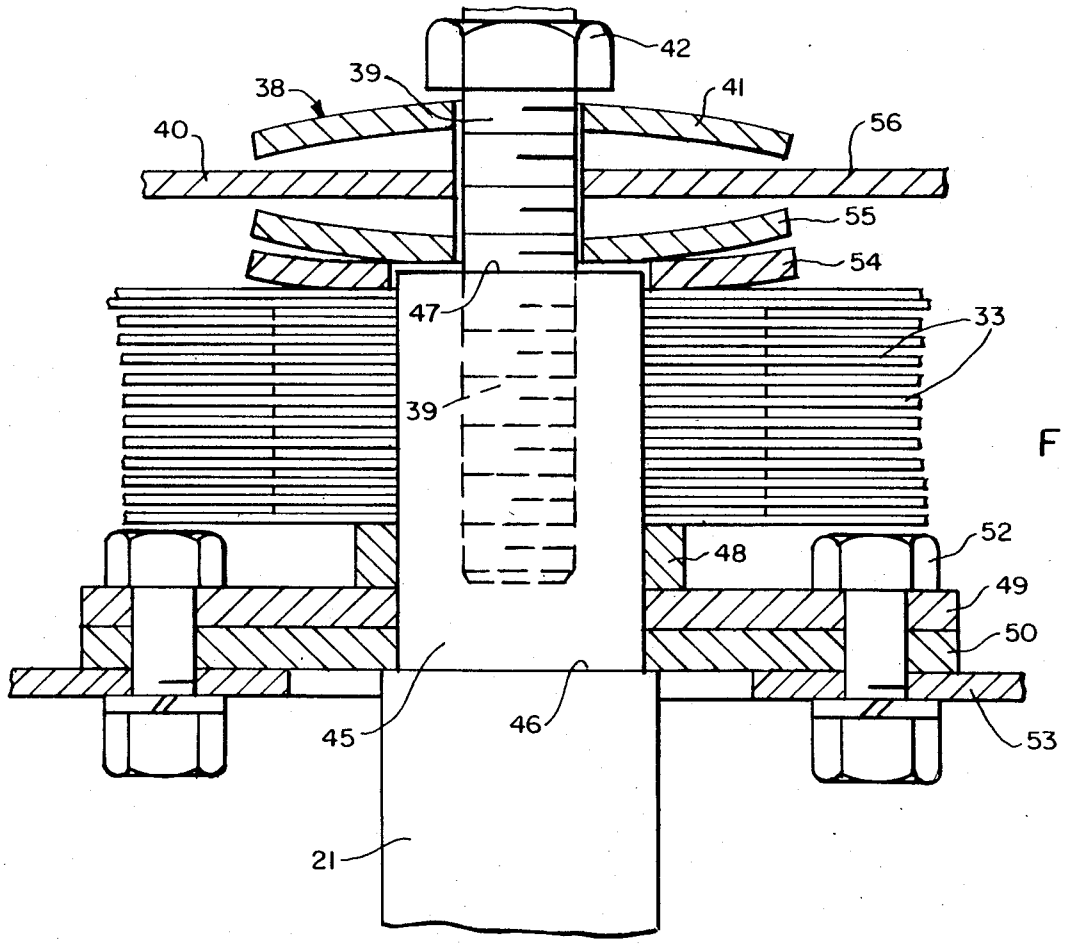
FIG. 5 is an elevational view, enlarged and partly in section, of the circuit breaker stationary stem, leaf conductor assembly, and the coupled portions of the heat exchanger assembly before the locking nut is tightened.

An important feature of the invention is the use of coupling disc washers 41, 55 that are slightly conical in shape when in relaxed condition so that the outer peripheral portions of the washers will be pressed flat into intimate contact with the sandwiched part of the central portion 56 of the heat exchanger 40 as the locking nut 42 is tightened. The coupling washer 54 which rests on and engages the conductor assembly 33 is similarly shaped. The slight conical configuration of the coupling disc washers 41, 54, 55 and the manner in which they are oriented during assembly is shown in FIG. 5 which illustrates the washers in relaxed condition before the locking nut 42 is tightened (the conical shape of the washers being greatly exaggerated for purposes of illustration). As will be noted, conical washer 41 is oriented so that it curves downwardly toward the flat central portion 56 of the heat exchanger 40 and the other two conical washers 54, 55 are arranged so that they both curve upwardly toward the central portion 56. The peripheries of washers 41, 55 thus "bite" into and firmly engage the central portion 56 of the heat exchanger 40 when locking nut 42 is tightened and washers 41, 55 are compressed flat. The compressive force exerted by the tightened locking nut 42 simultaneously flattens the other washer 54 and forces it down against the underlying leaf conductor assembly 33.

In order to achieve maximum heat transferring capability and cooling, the coupling disc washers 41, 54, 55 are fabricated from the same non-magnetic metal as the heat exchanger 40. Copper and aluminum are satisfactory metals for this purpose. The non-magnetic property is important since it prevents hysteretic heating of the heat exchanger 40 and disc washers 41, 54, 55 by the intense magnetic field produced by the current flowing through the contacts 19, 20, stems 21, 22 and leaf conductor assemblies 30, 33. Such heating would, of course, be undesirable since it would defeat the purpose of the cooling assembly 38.

Figure 6:
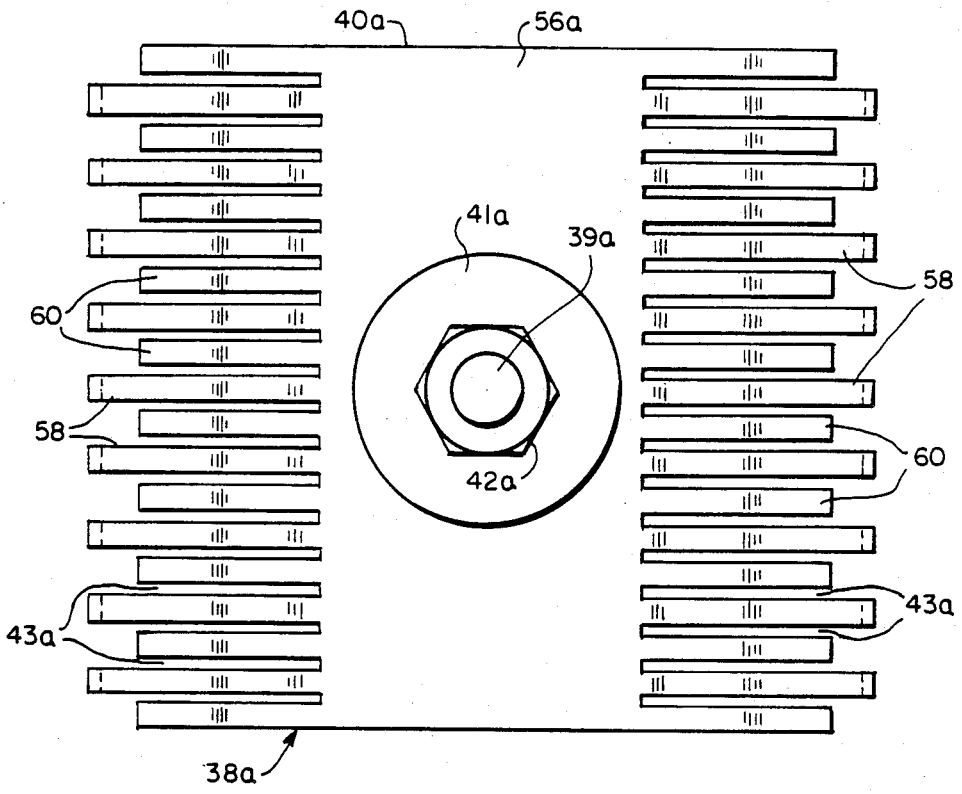
FIGS. 6 and 7 are plan and side elevational views, respectively, of an alternative form of heat exchanger cooling assembly according to the invention.
Figure 7:
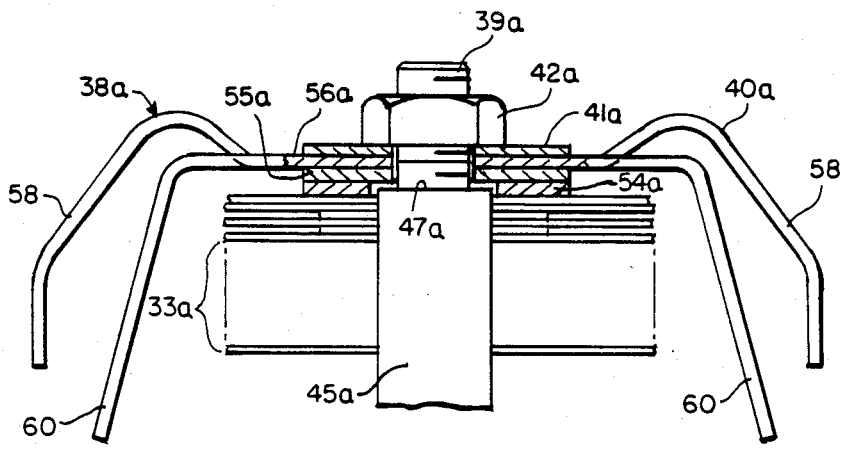

If desired, the heat transferring and cooling capability of the heat exchanger assembly 38 can be increased by utilizing an arrangement of spaced ribs that differ from those used in the embodiment just described. An alternative form of heat exchanger **38*a* is shown in FIGS. 6 and 7 and comprises a metal stamping of generally U-shaped cross-section having a series of narrow slot openings 43*a* in each of its skirt portions that provide a series of ribs 58, 60 that are of relatively narrow and uniform dimension compared to those of the previous embodiment. The alternately disposed ribs are bent outwardly and upwardly to provide a set of ribs 58 at each end of the heat exchanger 40***a* that are aligned with one another and laterally spaced and offset from the other set of ribs 60 that are not so bent. It has been found that the circulation of ambient air and the heat transfer and cooling characteristics of heat exchangers embodying this form of the present invention are improved by using such offset groupings of cooling ribs.

As in the previous embodiment, the flat central portion 56*a* of the heat exchanger 40*a* is tightly clamped in intimate engagement with the leaf conductor assembly 33*a* and threaded stud portion 39*a* of the associated breaker stem by conical-shaped washers 41*a*, 54*a*, 55*a* and a lock nut 42*a*.

As will be apparent to those skilled in the art, the physical size of the coupling washers and the U-shaped heat exchanger, as well as the particular metal from which they are fabricated and the number and arrangement of the cooling ribs, will be correlated with the size and rated current-carrying capacity of the vacuum circuit breaker to provide the required degree of convection cooling and temperature control.

I claim:

1. A vacuum type circuit interrupter apparatus comprising;

a sealed evacuated housing of insulating material containing a pair of separable contacts, one of said contacts being stationary and the other of said contacts being movable into and out of engagement with the stationary contact, a stem of electrically-conductive material joined to and supporting the stationary contact within said housing and extending through and beyond said insulative housing, and means for cooling said stem and contacts and preventing the overheating thereof when said contacts are engaged and are conducting current comprising a heat exchanger component of non-magnetic metal secured to the exposed end of said stem in contiguous relationship therewith, said heat exchanger component being of such configuration that the central portion thereof extends laterally beyond said stem and is terminated by skirt portions having a series of notches therein which provide a plurality of spaced rib-like members, said rib-like members being disposed in transversely-extending array relative to the central portion of said heat exchanger component and forming a grid at each end of said heat exchanger component that permits ambient air to pass through said heat exchanger component and thereby enhance the convection cooling thereof.

2. The vacuum type circuit interrupter apparatus of claim 1 wherein;

said housing of insulating material is of elongated tubular configuration, both of said contacts are supported within said tubular housing by electrically-conductive stems, said stems extend through and protrude from opposite ends of the tubular housing and are connected to contactor components by leaf conductor assemblies comprising a plurality of conductor members arranged in stacked and bundled relationship, and only the stem of the stationary contact is secured to and provided with a heat exchanger component.

3. The vacuum type circuit interrupter apparatus of claim 2 wherein;

the central portion of said heat exchanger component is substantially flat and has an aperture therein through which the exposed end of said stem extends, said heat exchanger component is coupled to said stationary stem by a pair of metal washers that encircle said stationary stem and are disposed in overlapping sandwiched relationship with the surfaces of the central portion of the heat exchanger component, and means on the exposed end of said stem clamps the metal coupling washers in pressured engagement with the contiguous parts of the apertured central portion of said heat exchanger component.

4. The vacuum type circuit interrupter apparatus of claim 3 wherein;

the exposed end of said stationary stem is of circular cross-section and terminated by a threaded stud, and said clamping means comprises a fastener disposed in threaded engagement with said stud.

5. The vacuum type circuit interrupter apparatus of claim 4 wherein;

a medial segment of the exposed end of said stationary stem that is located inward from and merges with the threaded stud is of larger diameter than the threaded stud and is fastened to the associated leaf conductor assembly, the apertures in said pair of metal washers and the central portion of said heat exchanger are of circular configuration and smaller than the said inwardly-located medial segment of said stationary stem, and a third metal washer is disposed between the associated leaf conductor assembly and the innermost one of said pair of metal washers, said third metal washer having a circular aperture that is larger than the diameter of the said medial segment of said stationary stem and being of such thickness that the innermost one of said pair of washers and the associated leaf conductor assembly are in pressured engagement with said third metal washer.

6. The vacuum type circuit interrupter apparatus of claim 5 wherein;

each of the skirt portions of said heat exchanger component are bent toward said tubular insulative housing and the grids are disposed on opposite sides of and spaced from said tubular insulative housing, and said heat-exchanger component is of generally U-shaped configuration with the grids disposed in substantially parallel spaced-apart relationship and extending transversely from the central portion of said heat-exchanger component.

7. The vacuum type circuit interrupter apparatus of claim 6 wherein;

said stationary stem has a body portion that is larger in diameter than the said medial segment of said stationary stem and thus provides a laterally-extending flange on said stationary stem, and the bundled conductors of the conductor assembly that is connected to said stationary stem are disposed in encircling relationship with the said medial segment of said stationary stem and are supported in such position by means which engages and is seated on the laterally-extending flange.

8. The vacuum type circuit interrupter apparatus of claim 6 wherein said notches comprise slot openings that are of substantially uniform length and width and said rib-like members are of substantially the same size.

9. The vacuum type circuit interrupter apparatus of claim 6 wherein the rib-like members which comprise the respective grids are substantially disposed in planes and alternately-disposed rib-like members in each of the grids are displaced from the planes of the respective grids and provide two sets of offset rib-like members and a grid configuration that improves the heat transfer characteristics of said heat exchanger.

10. The vacuum type circuit interrupter apparatus of claim 6 wherein;

said fastener comprises a threaded lock nut, and said pair of metal washers, as formed, are of substantially conical cross-sectional configuration and are compressed flat by the threaded lock nut, the size, configuration and orientation of said pair of metal washers being such that the compression flattening thereof forces the outer peripheral portions of the respective metal washers into intimate pressured contact with the contiguous overlapped parts of the central portion of said heat exchanger component.

* * * * *